US007856771B2

(12) United States Patent
Guidos et al.

(10) Patent No.: US 7,856,771 B2
(45) Date of Patent: Dec. 28, 2010

(54) EXTRUDED CORNER MOLDING SET

(75) Inventors: Michael Guidos, Lake Arrowhead, CA (US); Michael H. Clark, Alta Loma, CA (US)

(73) Assignee: Shower Enclosures America, Ontario, CA (US)

( * ) Notice: Subject to any disclaimer, the term of this patent is extended or adjusted under 35 U.S.C. 154(b) by 18 days.

(21) Appl. No.: 12/038,176

(22) Filed: Feb. 27, 2008

(65) Prior Publication Data

US 2009/0211175 A1 Aug. 27, 2009

(51) Int. Cl.
*E06B 3/964* (2006.01)

(52) U.S. Cl. ..... 52/204.62; 52/282.4; 52/207; 52/204.1; 52/584.1

(58) Field of Classification Search ..... 52/282.4, 52/207, 204.1, 204.62, 204.66, 204.67, 79.12, 52/584.1, 656.1, 710; 4/614
See application file for complete search history.

(56) References Cited

U.S. PATENT DOCUMENTS 5,622,017 A * 4/1997 Lynn et al. ..... 52/209
5,860,264 A * 1/1999 Gephart et al. ..... 52/656.4
2009/0038070 A1 * 2/2009 Belanger et al. ..... 4/607

OTHER PUBLICATIONS

Applicant's admitted Prior Art (Figs. 1-3).*

* cited by examiner

*Primary Examiner*—Basil Katcheves
*Assistant Examiner*—Branon C Painter
(74) *Attorney, Agent, or Firm*—Patent Law Agency, LLC; Peter Ganjian

(57) ABSTRACT

A set of extruded interlocking moldings joins together panels of framed glass and/or framed glass doors. A first molding has a channel along an edge of one face and a groove in the opposite face. A second molding has a tongue extending along an edge of one face and a flange along an edge of the opposite face. The channel of the first molding is configured to receive and hold the tongue of the second molding to secure the moldings together as the panels are aligned. The flange of the first molding snaps into the groove of the second molding when the moldings are rotated to a predetermined angle with respect to each other.

13 Claims, 4 Drawing Sheets

EXTRUDED CORNER MOLDING SET

BACKGROUND OF THE INVENTION

1. Field of the Invention

This invention relates to extruded moldings and, more particularly, to a set of interlocking extrusions for use in attaching panels of a shower enclosure.

2. Background

Certain shower enclosures, such as are used in recreational vehicles and the like, are constructed of prefabricated glass panels and at least one door panel that includes a door and doorframe. During the installation of such a shower enclosure, it is required to join together multiple panels of glass and their respective frames that protect the edges of the glass. One example of such a shower enclosure is designed for a corner installation with three panels, two adjoining the walls and perpendicular thereto, and a third, often comprising the door and doorframe, diagonally between the other two at a 135° angle with respect to each. This is often referred to as a "Neo-Angle" shower design.

There are numerous connection systems for attaching adjoining panels of framed glass of shower enclosures. Most existing shower enclosures use some form of an interlocking design feature to engage multiple glass panels/doorframes within the installation process, however there remains additional room for improvement.

During the installation process it is required to quickly and safely bring together and stabilize multiple glass panels/doorframes prior to permanent engagement. During this initial assembly and adjustment process, there is usually one installer who must maneuver numerous panels/doorframes at the same time prior to fastening them together in a "permanent" engagement. Existing shower enclosures lack a feature that is effective in securing the panels prior to the permanent fastening stage. Disengagement of adjoining panels during installation is problematic as a result of delays in the installation process as well as the risk for damaged property and personal injury to the installer.

SUMMARY OF THE INVENTION

The present invention provides a set of extruded interlocking moldings that provide a unique and superior method of joining together panels of framed glass and/or framed glass doors. A first molding has a channel along an edge of one face and a groove in the opposite face. A second molding has a tongue extending along an edge of one face and a flange along an edge of the opposite face. The channel of the first molding is configured to receive and hold the tongue of the second molding to secure the moldings together as the panels are aligned. The flange of the first molding snaps into the groove of the second molding when the moldings are rotated to a predetermined angle with respect to each other.

Some of the benefits of the present invention are:

An easier, safer and quicker installation. A "leading-outside-engagement feature" of the extrusions engages in a manner so that when the extrusions are rotated toward the permanent engagement position, the connection does not allow separation in the installation process.

A secure connection between the door and fixed panels. Following the leading-outside-engagement feature connection, an "inside-engagement feature" then engages in a "snapping" function that locks and holds the panels permanently in the proper alignment. Upon permanent engagement, the relationship of the leading-outside-engagement feature and the inside-engagement feature reduces lateral or twisting action. The resulting strength of the fully assembled joint (i.e. "permanent" engagement) precludes the need of using fasteners to secure the panels together.

Saving in material cost. The strength and stability of the fully assembled joint inherent in the moldings of the present invention reduces the amount of frame material required. Conventional frame moldings are thicker to accommodate fasteners, typically 3-5 screws per post, and access thereto. Since no fasteners are needed to assemble the moldings of the present invention, they can be substantially thinner. As a result, it is feasible to reduce the width of the frame material by up to 50%.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
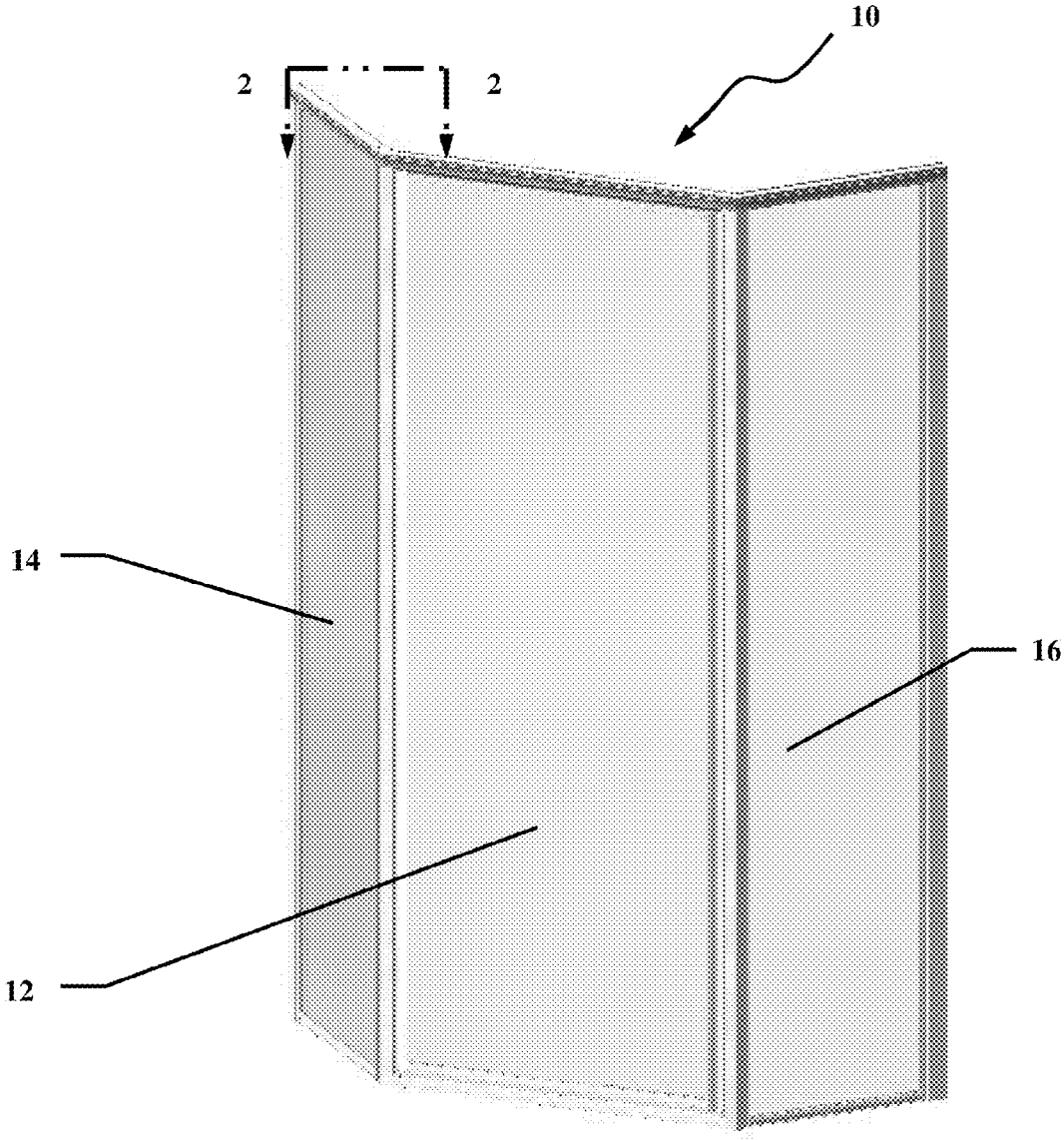
FIGURE 1 (PRIOR ART)
FIG. 1 is a perspective view of a prior art shower enclosure.

FIG. 1 is a perspective view of a typical Neo-Angle shower installation utilizing prior art extruded moldings. Enclosure 10 comprises a door and doorframe 12 and two fixed panels 14,16 on either side of the door. The fixed panels are attached to the walls and the doorframe is attached between the fixed panels along each side edge.

Figure 2:
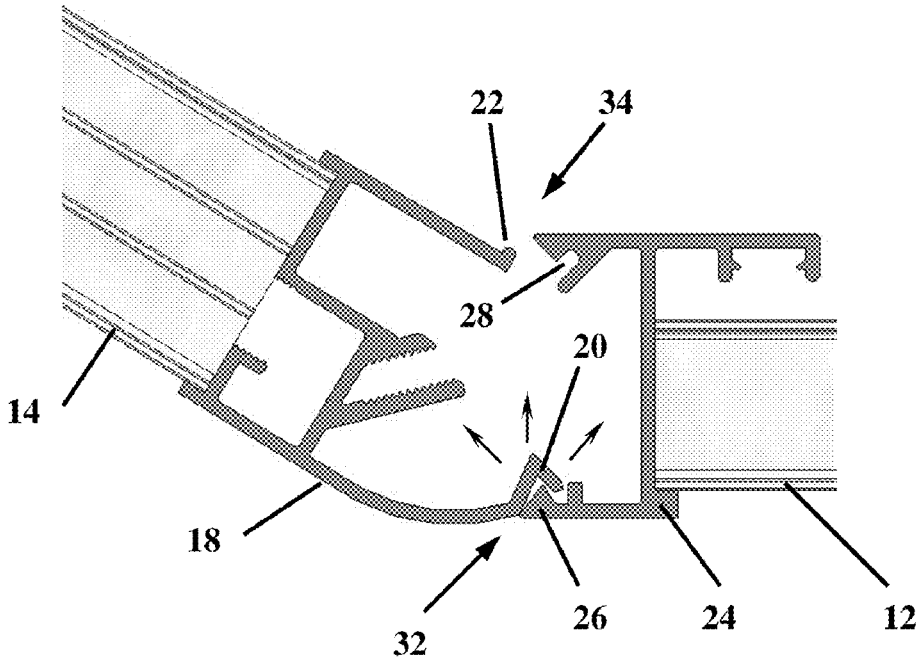
FIGURE 2 (PRIOR ART)
FIG. 2 is a detailed cross-sectional view of a pair of prior art moldings for forming a corner of a shower enclosure.

FIG. 2 is a cross-sectional view of the prior art extruded moldings 18 and 24 that form the adjoining edges of panel 14 and door/doorframe panel 12. During installation of a typical Neo-Angle shower joint design, the adjoining panels are initially brought together prior to the permanent fastening stage. To facilitate this initial alignment, panel edge molding 18 has a hook-shaped leading edge 20 that engages a rearward facing protrusion 26 on doorframe molding 24. These features are referred to collectively as "leading-outside-engagement feature" 32. This engagement feature, while helpful for initially aligning the panels, fails to positively engage the two moldings and therefore allows the panels to become easily disengaged, particularly when subjected to the tilting and twisting forces that are commonly applied during panel alignment. Notice, in particular, how the shape of the leading-outside-engagement feature 32 of extrusions 18 and 24 allows panel 14 to separate from doorframe 12 in any of the indicated directions during the initial assembly and adjustment process.

Figure 3:
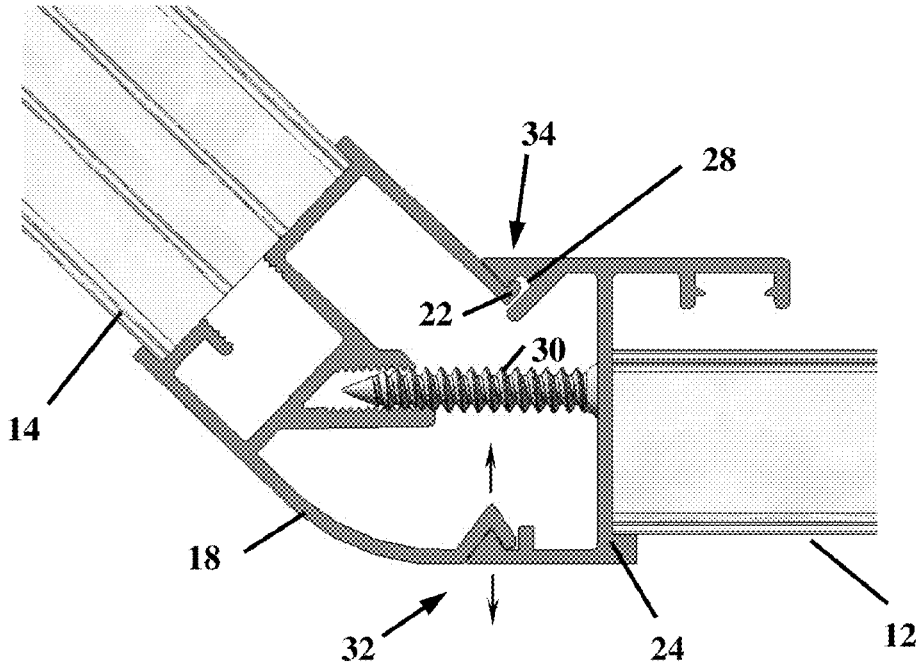
FIGURE 3 (PRIOR ART)
FIG. 3 is a detailed cross-sectional view of the moldings shown in FIG. 2 after being permanently attached.

Prior art moldings 18 and 24 also incorporate an "inside-engagement feature" 34 comprising flange 22 on panel edge molding 18 and groove 28 in doorframe molding 24. After the leading-outside-engagement feature 32 has been engaged, panel 12 is rotated counter-clockwise to engage flange 22 in groove 28 as shown in FIG. 3. Note, however, that engagement of both the leading-outside-engagement feature 32 and the inside-engagement feature 34 is insufficient to lock panel 14 and doorframe 12 together into permanent engagement because they fail to hold the panel and doorframe under lateral or twisting forces. Thus, shower enclosures constructed with prior art moldings 18 and 24 require the use of a plurality of fasteners 30 (only one of which is seen in the figure) to "lock" the adjoining panels together. All of the existing connection systems require multiple fasteners, usually three to five screws per connection, to permanently join the frame edges of the door panel and stationary panel. Since these existing connection systems require the use of screws, larger frame sections, which require more raw material, are necessary to allow space both for the screws and for access to the screws during assembly.

Many prior art shower enclosure joint designs use both outside and inside engagement features similar to those described above; however, such engagement features nevertheless allow separation of the adjoining panels. Even with the use of screws 30 to fasten moldings 18 and 24 together, the assembly is still prone to gaps along the joints 32 and 34 due to the flexibility of the aluminum moldings. Note, in particular, that the leading-outside-engagement feature 32 does not positively lock together and therefore allows the moldings to separate as indicated by the arrows in FIG. 3. The resulting gap is not only aesthetically displeasing, but the separation of the moldings also reduces the structural integrity of the shower enclosure. Typically, only 3-5 screws are used along the length of the moldings. The use of additional screws would reduce the severity of the gaps, but would increase the material and assembly costs. The present invention also uses outside and inside engagement features; however, the design of the engagement features differs from the prior art in form, fit and function to achieve a variety of benefits.

Figure 4:
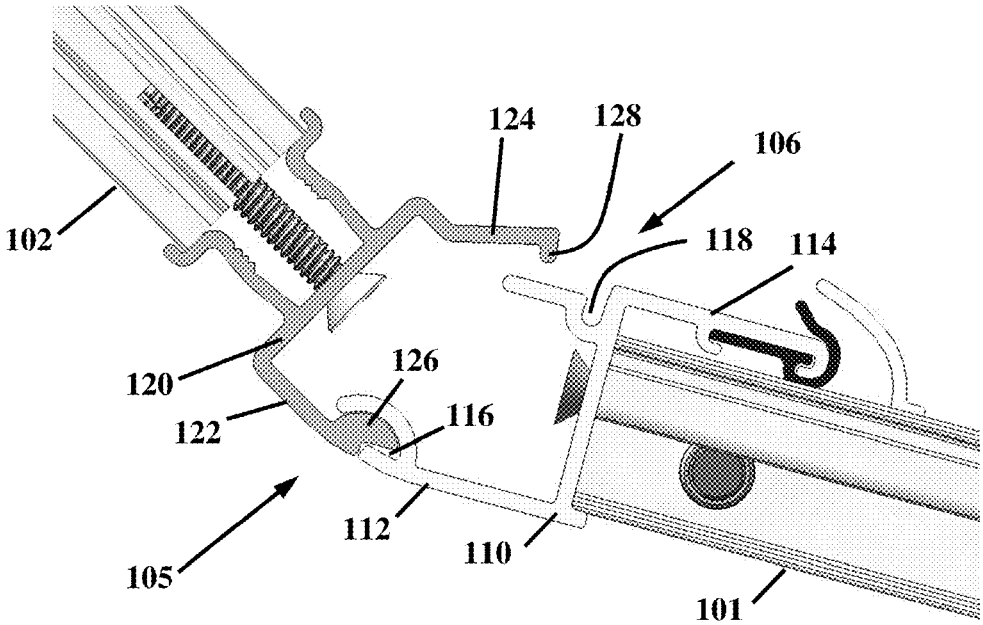
FIG. 4 is a detailed cross-sectional view of a pair of moldings in accordance with an embodiment of the present invention.

Referring now to FIG. 4, a pair of extruded moldings in accordance with an embodiment of the present invention are shown in cross section. Doorframe molding 110 is attached to the edge of door/doorframe panel 101. Molding 110 includes a channel 116 along the edge of front face 112 and a groove 118 in the rear face 114. Panel edge molding 120 is attached to the edge of fixed panel 102. Molding 120 includes tongue 126 extending along the edge of front face 122 and a flange 128 along the edge of rear face 124. A leading-outside-engagement feature, designated generally as 105, comprises channel 116 of doorframe molding 110 and tongue 126 of panel edge molding 120. This is the first feature to be engaged during installation.

The leading-outside-engagement feature 105 becomes engaged as tongue 126 is captured within channel 116. This first occurs when the door/doorframe panel 101 is at an angle of approximately 165° with respect to the fixed panel 102. Once feature 105 is initially engaged, the door/doorframe panel's angle of orientation can be rotated slightly counter-clockwise (as viewed in FIG. 4) toward a permanent engagement position in which feature 105 is in contact along the entire vertical length. At this point, the two moldings are held securely together by the full-length capture of tongue 126 within channel 116. Note how the shape of the leading-outside-engagement feature 105 of the extrusions engage in a manner so that once engaged, the connection does not allow separation in any direction. This greatly facilitates the initial assembly and adjustment process, when usually one installer must maneuver numerous panels and a doorframe at the same time prior to their "permanent" attachment. The stability of the multiple glass panels afforded by the present invention results in an easier, safer and quicker installation process.

Figure 5:
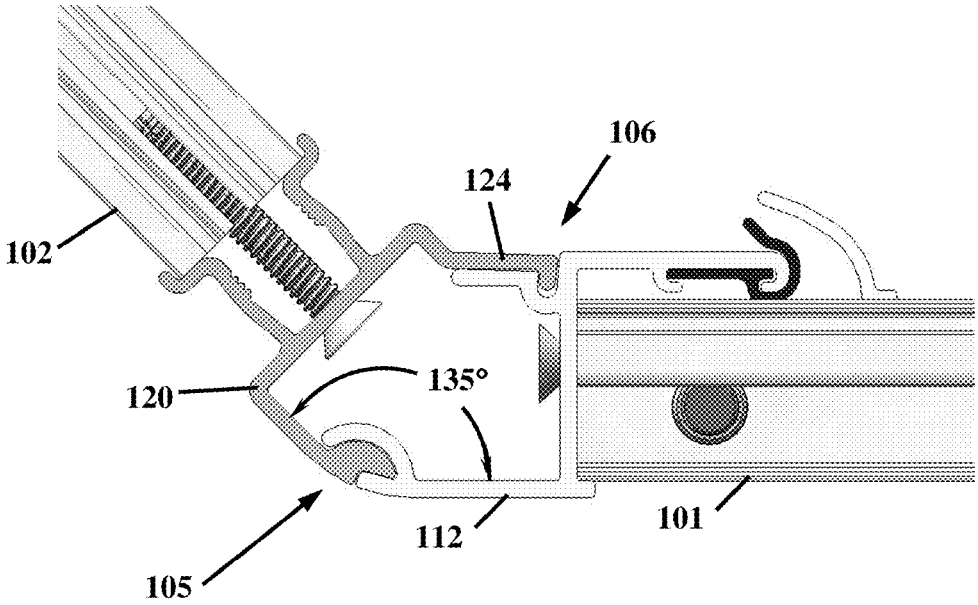
FIG. 5 is a detailed cross-sectional view of the moldings shown in FIG. 4 after being permanently attached.

With reference also to FIG. 5, an inside-engagement feature, designated generally as 106, comprises groove 118 of doorframe molding 110 and flange 128 of panel edge molding 120. From the position shown in FIG. 4, the door/doorframe panel 101 may be further rotated in a counter-clockwise direction to its permanent engagement position where flange 128 "snaps" into groove 118 to lock and hold the panels permanently in the proper alignment, providing a secure connection between the door/doorframe panel 101 and the fixed panel 102 without the use of fasteners. In the example shown, the flange snaps into the groove when the panels are at an angle of about 135°.

Figure 6:
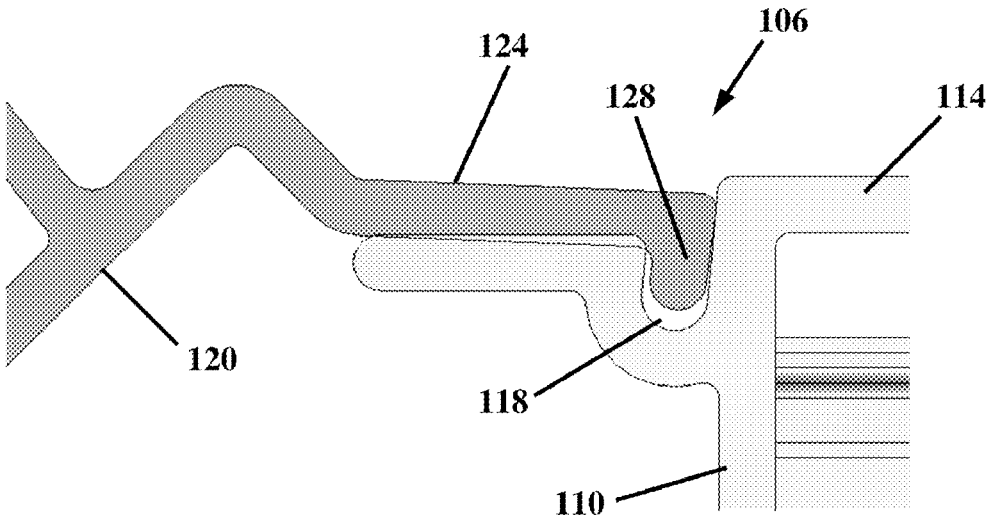
FIG. 6 is a magnified view of the inside engagement feature of the present invention.

Referring also to FIG. 6, the moldings 110 and 120 are configured so that molding 120 is "sprung" slightly when fully engaged with molding 110, thereby urging the rear face 124 against rear face 114 and urging flange 128 into groove 118. This self-locking feature of the joint obviates the need for additional fasteners to secure the panels together. Upon permanent engagement, the relationship of the leading-outside-engagement feature 105 and the inside-engagement feature 106 locks the panels together under any type of lateral or twisting force and thereby greatly reduces vibration and squeaking. The finished joint also allows for an aesthetically desirable flush mating of both the inside and outside surfaces of the shower enclosure, which is a major advantage of the present invention over the prior art.

Figure 7:
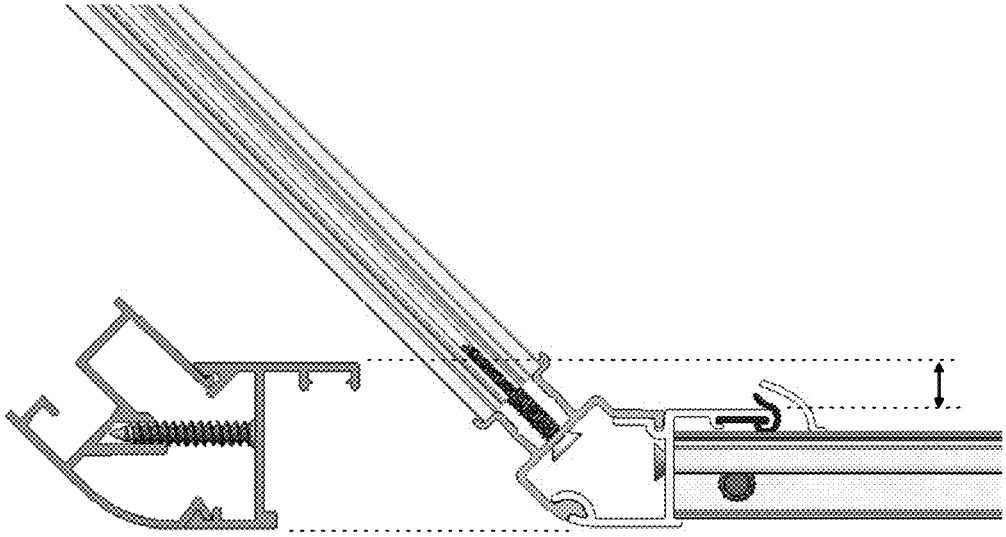
FIG. 7 illustrates the reduction in material made possible with the present invention.

As explained above, the strength and stability of the fully assembled joint inherent in the moldings of the present invention obviates the need for mechanical fasteners such as screws. This allows for substantially thinner moldings and reduces the amount of frame material required. FIG. 7 presents a comparison of the moldings of the present invention to those of the prior art to illustrate the reduction in material that can be achieved with the present invention.

The present invention has been described with reference to a particular example of a shower enclosure; however, the invention may be applied in any application requiring the connection of adjoining panels. For example, while the invention has been described in the context of panels joined at an angle of 135°, suitably modified moldings substantially similar to those described above may be provided for joining panels at any desired angle. Furthermore, the invention has been described with reference to a tongue and channel engagement feature on the front faces of the interlocking extrusions and a flange and groove engagement feature on the rear faces. However, these engagement features could be reversed, yet still provide similar functionality and benefits.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A set of extruded moldings comprising:

a first molding includes a first connection base that is perpendicular to opposing front and rear faces, the front face of the first molding includes:

a free distal end that bifurcates to form a channel along an edge of the front face of the first molding, with a channel opening facing away from and opposite the first connection base of the first molding;

the bifurcated free distal end forming the channel is comprised of:

a first branch and a second branch that diverge from a vertex of the bifurcated free distal end;

the first branch is a continuous curve protruded from the edge of the front face of the first molding and forming an arc that includes an interior curved side of the channel and;

a second branch that is primarily a straight-line continuation of the edge of the front face of the first molding that faces an interior concaved side of the channel, and has a length that is shorter than a full span of the first branch, and is slightly bent towards the first branch, with the bend commencing at the vertex of the bifurcated free distal end;

the rear face of the first molding includes:

a first distal portion, distal from the first connection base of the first molding, forming a free end that is straight and extends toward a second molding;

a second proximal portion near the first connection base of the first molding that has a slanted groove, with a first wall of the slanted groove comprised of a portion of the first connection base of the first molding, the slanted groove is oriented away from the front face of the first molding, and slanted away from a second molding;

the second molding includes a second connection base that is perpendicular to opposing first and second faces;

the first face of the second molding includes:

a first distal end having a protuberance extending along a first edge of the first face of the second molding, having a commensurately formed silhouette along a continuous periphery edge of the protuberance with curved and straight sections that complement and interlock into the curved and straight channel sections of the channel of the front face of the first molding;

the silhouette of the protuberance includes:

a first periphery that is adjacent to and substantially perpendicular in relation to the first edge of the first face of the second molding, contacting a free edge of the second branch, a second periphery that is substantially parallel in relation to the first edge of the first face of the second molding that contacts with the second branch, with a second periphery tip that contacts the vertex of the bifurcated free distal end; and a third periphery that is a protruded curve between the second periphery tip and a section of front face of the second molding, with the third periphery contacting the interior curved side of the first branch within the channel;

the second face of the second molding includes:

a first integral part that is straight and a second integral part distal from the second connection base of the second molding that has a slanted flange extended at an angle toward the first face of the second molding, with a free distal end of the slanted flange sloped away from the first connection base of the first molding;

with the slanted flange commensurately formed to complement and interlock into the slanted groove, while the first integral part of the second face of the second molding that is straight contacts the first distal portion of the rear face of the first molding;

wherein the slopes of the slanted flange and the slanted groove are oriented slightly toward the second molding, providing a mechanical biasing scheme that generates a holding strength that is increased under tensile forces that attempt to separate the flange from the groove when both are interlocked with one another; and wherein the channel of the first molding is configured to receive and hold the protuberance of the second molding and subsequently, the slanted flange of the second molding snaps into the slanted groove of the first molding when, with the protuberance engaged in the channel, the first and second moldings are rotated to a predetermined angle with respect to each other.

2. The set of claim 1 wherein the predetermined angle is approximately 135°.

3. The set of claim 1 wherein the second face of the second molding is biased against the rear face of the first molding when the first and second moldings are fully engaged.

4. The set of claim 1 wherein the front face of the first molding and the first face of the second molding are front faces.

5. The set of claim 1 wherein the first molding is a doorframe molding and the second molding is a glass panel edge molding.

6. The set of claim 5 wherein the doorframe and the glass panel are configured to form a portion of a shower enclosure.

7. A set of extruded moldings comprising:

a first molding having a first outside engagement feature and a first inside engagement feature; and a second molding having a second outside engagement feature and a second inside engagement feature;

the first outside engagement feature of the first molding is configured to receive and hold the second outside engagement feature of the second molding when the first and second moldings are oriented at a first predetermined angle with respect to each other; and the second inside engagement feature of the second molding positively engages the first inside engagement feature of the first molding when the first and second moldings are rotated to a second predetermined angle with respect to each other;

the first outside engagement feature of the first molding includes a channel facing away from and opposite a first connection base of the first molding, the channel includes a curved section and a straight section, with the curved section protruded at an angle from an edge of the first molding, with an interior concaved side of the curved section facing the straight section of the channel, and a convex section facing the first and second inside engagement features;

the second outside engagement feature of the second molding includes a protuberance, having a commensurately formed silhouette along a continuous periphery edge of the protuberance that complements and interlocks into the channel of the first outside engagement feature of the first molding;

the silhouette of the protuberance is comprised of:

a first periphery that is adjacent to and substantially perpendicular in relation to a first edge of a first face of the second molding, contacting a free edge of the second channel, a second periphery that is substantially parallel in relation to the first edge of the first face of the second molding and contacts the straight section of the channel, with a second periphery tip that contacts the vertex of the channel sections; and a third periphery that is a protruded curve between the second periphery tip and a section of front face of the second molding, with the third periphery contacting the curved section of the channel;

the first inside engagement feature of the first molding includes a first distal portion, distal from the first connection base of the first molding, which is straight and extends toward a second molding and a second proximal portion near the first connection base of the first molding that has a slanted groove, with a first wall of the slanted groove comprised of a section of the first connection base of the first molding, with the slanted groove facing away from the first and second outside engagement features and slanted away from the second molding;

the second inside engagement feature of the second molding includes a first integral part that is straight and a second integral part distal from a second connection base of the second molding that has a slanted flange that extends at an angle towards the first and second outside engagement features, with the free end of the slanted flange sloped away from the first connection base of the first molding;

the slanted flange is commensurately formed to complement and interlock into the slanted groove of the first inside engagement feature of the first molding, while the first integral part contacts the first straight portion of the first inside engagement feature of the first molding, and wherein the slope of slanted flange and slanted groove is oriented slightly toward the second molding, providing a mechanical biasing scheme that generates a holding strength that is increased under tensile forces that attempt to separate the flange from the groove when both are interlocked with one another.

8. A set of panels for a shower enclosure comprising:

a first panel having a first molding along an edge of the first panel;

the first molding having a first connection base perpendicular to opposing front and rear faces, the front face of the first molding includes:

a free distal end that bifurcates to form a a channel along an edge of the front face of the first molding, with a channel opening facing away from and opposite the first connection base of the first molding;

the bifurcated free distal end forming the channel is comprised of:

a first branch and a second branch that diverge from a vertex of the bifurcated free distal end;

the first branch is a continuous curve protruded from the edge of the front face of the first molding and forming an arc that includes an interior curved side of the channel, and a second branch that is primarily a straight-line continuation of the edge of the front face of the first molding that faces an interior concaved side of the channel, has a length that is shorter than a full span of the first branch, and is slightly bent towards the first branch, with the bend commencing at the vertex of the bifurcated free distal end;

the rear face of the first molding includes:

a first distal portion, distal from the first connection base of the first molding, forming a free end that is straight and extends toward a second molding; and a second proximal portion near the first connection base of the first molding that has a slanted groove, with a first wall of the slanted groove comprised of a portion of the first connection base of the first molding, the slanted groove is oriented away from the front face of the first molding, and slanted away from a second molding;

a second panel having the second molding along an edge of the second panel;

the second molding includes a second connection base that is perpendicular to opposing first and second faces;

the first face of the second molding includes:

a first distal end having a protuberance extending along a first edge of the first face of the second molding, having a commensurately formed silhouette along a continuous periphery edge of the protuberance with curved and straight sections that complement and interlock into the curved and straight channel sections of the channel of the front face of the first molding;

the silhouette of the protuberance is comprised of:

a first periphery that is adjacent to and substantially perpendicular in relation to the first edge of the first face of the second molding, contacting a free edge of the second branch, a second periphery that is substantially parallel in relation to the first edge of the first face of the second molding that contacts with the second branch, with a second periphery tip that contacts the vertex of the bifurcated free distal end; and a third periphery that is a protruded curve between the second periphery tip and a section of front face of the second molding, with the third periphery contacting the interior curved side of the first branch within the channel;

the second face of the second molding includes:

a first integral part that is straight and a second integral part distal from the second connection base of the second molding that has a slanted flange extended at an angle toward the first face of the second molding, with the free distal end of the slanted flange sloped away from the first connection base of the first molding;

with the slanted flange commensurately formed to complement and interlock into the slanted groove, while the first integral part of the second face of the second molding that is straight contacts the first distal portion of the rear face of the first molding;

wherein the slopes of the slanted flange and the slanted groove are oriented slightly toward the second molding, providing a mechanical biasing scheme that generates a holding strength that is increased under tensile forces that attempt to separate the flange from the groove when both are interlocked with one another; and wherein the channel of the first molding is configured to receive and hold the protuberance of the second molding when the first and second panels are oriented at a first predetermined angle with respect to each other and wherein the slanted flange of the second molding snaps into the slanted groove of the first molding when, with the protuberance engaged in the channel, the first and second panels are rotated to a second predetermined angle with respect to each other.

9. The set of claim 8 wherein the first predetermined angle is approximately 165°.

10. The set of claim 8 wherein the first predetermined angle is approximately 135°.

11. The set of claim 8 wherein the second face of the second molding is biased against the second face of the first molding when the first and second moldings are fully engaged.

12. The set of claim 8 wherein the first panel comprises a door and doorframe and the second panel comprises a glass panel.

13. A set of extruded moldings comprising:

a first molding having a first outside engagement feature and a first inside engagement feature; and a second molding having a second outside engagement feature and a second inside engagement feature;

the first outside engagement feature of the first molding includes a channel, with a channel opening that is oriented away from and opposite to a first connection base of the first molding;

the second outside engagement feature of the second molding is inserted into the channel, with the channel having a profile that substantially encloses and confines a substantial majority surface of the second outside engagement feature, the second outside engagement feature including a first side that faces the first inside engagement feature, a second side that is opposite the first side, and a third side that is opposite the channel opening;

with the first outside engagement feature of the first molding and the second outside engagement feature of the second molding rotatably interlocked, with the second outside engagement feature pivotally maintained and positively locked within the channel of the first outside engagement feature, with the oppositely oriented channel opening preventing disengagement of the second molding in relation to the first molding;

the first inside engagement feature of the first molding is comprised of a first distal portion, distal from the first connection base of the first molding, forming a free end that is straight; and a second proximal portion near the first connection base of the first molding that has a slanted groove, with a first wall of the slanted groove comprised of a section of the first connection base of the first molding, the slanted groove is oriented away from the front face of the first molding, and slanted away from a second molding;

the second inside engagement feature of the second molding positively engages the first inside engagement feature of the first molding when the first and second moldings are rotated to a second predetermined angle with respect to each other, while the first and the second outside engagement features remain interlocked; and wherein mating of the inside and outside engagement features allow for a flush inside and outside engagement surfaces in which a seam between the moldings is minimized and locked together.

* * * * *